US011622604B2

(12) United States Patent
Bessho et al.

(10) Patent No.: US 11,622,604 B2
(45) Date of Patent: Apr. 11, 2023

(54) LAST, METHOD FOR PRODUCING LAST, AND METHOD FOR PRODUCING SHOE UPPER

(71) Applicant: ASICS CORPORATION, Kobe (JP)

(72) Inventors: Ayu Bessho, Kobe (JP); Norihiko Taniguchi, Kobe (JP); Satoru Abe, Kobe (JP); Shingo Takashima, Kobe (JP); Yuya Kozuka, Kobe (JP)

(73) Assignee: ASICS CORPORATION, Kobe (JP)

( * ) Notice: Subject to any disclaimer, the term of this patent is extended or adjusted under 35 U.S.C. 154(b) by 0 days.

(21) Appl. No.: 16/915,245

(22) Filed: Jun. 29, 2020

(65) Prior Publication Data

US 2021/0186163 A1 Jun. 24, 2021

(30) Foreign Application Priority Data

Dec. 19, 2019 (JP) ..... JP2019-229047
May 14, 2020 (JP) ..... JP2020-084990

(51) Int. Cl.
*A43D 3/02* (2006.01)

(52) U.S. Cl.
CPC ..... *A43D 3/02* (2013.01)

(58) Field of Classification Search
CPC ..... A43D 3/02; A43D 2200/60; A43D 3/027; A43D 1/025; A43D 1/02; A43B 1/0054;
(Continued)

(56) References Cited

U.S. PATENT DOCUMENTS 1,565,057 A 12/1925 Chappell
2,560,992 A * 7/1951 Schlueter ..... B27M 3/20 12/146 L (Continued)

FOREIGN PATENT DOCUMENTS

CN 207444401 U 6/2018
CN 109732913 A 5/2019

(Continued)

OTHER PUBLICATIONS https://twitter.com/mrnickharvey/status/535169051220520961?ref_src=twsrc%255Etfw%257Ctwcamp%255Etweetembed%257Ctwterm%255E535169051220520961%257Ctwgr%255E%257Ctwcon%255Es1_&ref_url=https%253A%252F%252Fmetro.co.uk%252F2014%252F11%252F21%252Fman-makes-lego-shoes-wins-lego-forever-4957164%252F (Year: 2014).*

(Continued)

*Primary Examiner* — Clinton T Ostrup
*Assistant Examiner* — Akwokwo Olabisi Redhead
(74) *Attorney, Agent, or Firm* — Studebaker & Brackett PC

(57) ABSTRACT

A last is provided for shaping a shoe upper, such as a custom-made last tailored to a user's foot. Embodiments include a last for shaping a shoe upper including at least an outer peripheral portion comprising an aggregate of a plurality of blocks, the plurality of blocks being joinable together to form a portion of the last and shape the shoe upper, and separable from each other after being joined together. The plurality of blocks includes a first plurality of blocks which are identical to each other. Embodiments also include a method for producing a last for shaping a shoe upper, the method including forming the last by joining a (Continued)

plurality of blocks together to form an aggregate, the plurality of blocks including a first plurality of blocks which are identical to each other.

19 Claims, 18 Drawing Sheets

(58) Field of Classification Search
CPC ..... A43B 1/04; A43B 3/0047; A43B 23/0205; A43B 23/0215; D06C 7/02
See application file for complete search history.

(56) References Cited

U.S. PATENT DOCUMENTS

| | | | | |
|---|---|---|---|---|
| 2007/0033750 | A1 | 2/2007 | Cook et al. | |
| 2009/0044429 | A1 | 2/2009 | Cook et al. | |
| 2010/0275392 | A1 | 11/2010 | Cook et al. | |
| 2010/0275461 | A1 | 11/2010 | Cook et al. | |
| 2016/0206049 | A1 | 7/2016 | Kallayil | |
| 2018/0014609 | A1 | 1/2018 | Bruce et al. | |
| 2018/0237964 | A1 | 8/2018 | Adami et al. | |
| 2018/0317610 | A1 | 11/2018 | Golub | |
| 2019/0152149 | A1 | 5/2019 | Arayama | |
| 2020/0113291 | A1 | 4/2020 | Smith | |
| 2021/0112926 | A1* | 4/2021 | Bessho ..... | A43B 23/0245 |

FOREIGN PATENT DOCUMENTS

| | | | |
|---|---|---|---|
| CN | 209106400 | U | 7/2019 |
| EP | 3 808 202 | A1 | 4/2021 |
| WO | 2017/078168 | A1 | 5/2017 |
| WO | 2020/077093 | A1 | 4/2020 |

OTHER PUBLICATIONS https://www.youtube.com/watch?v=T8IR9MAIwqg; How to Build an Air Jordan One Retro in LEGO!! + Updates; YouTube; Sep. 8, 2018 (Year: 2018).*

ItsJustNaf, "How to Build an Air Jordan One Retro in LEGO!! + Updates", Online Video Clip. YouTube. (Sep. 8, 2018) Web.https://www.youtube.com/watch?v=T8IR9MAIwqg (Year: 2018).*

The extended European search report issued by the European Patent Office dated Dec. 16, 2020, which corresponds to European Patent Application No. 20182729.2-1011 and is related to U.S. Appl. No. 16/915,245.

An Office Action; "Notice of Reasons for Refusal", mailed by the Japanese Patent Office dated Jul. 16, 2021, which corresponds to Japanese Patent Application No. 2020-084990 and is related to U.S. Appl. No. 16/915,245; with English language translation.

Communication pursuant to Article 94(3) EPC issued by the European Patent Office dated Dec. 21, 2021 , which corresponds to European Patent Application No. 20 182 729.2-1005 and is related to U.S. Appl. No. 16/915,245.

An Office Action; "Notice of Reasons for Refusal", mailed by the Japanese Patent Office dated Jan. 28, 2022, which corresponds to Japanese Patent Application No. 2020-084990 and is related to U.S. Appl. No. 16/915,245; with English language translation.

Communication pursuant to Article 94(3) EPC issued by the European Patent Office dated Apr. 28, 2022, which corresponds to European Patent Application No. 20 182 729.2-1015 and is related to U.S. Appl. No. 16/915,245.

Communication pursuant to Article 94(3) EPC issued by the European Patent Office dated Nov. 2, 2022, which corresponds to European Patent Application No. 20182729.2-1015 and is related to U.S. Appl. No. 16/915,245.

* cited by examiner

LAST, METHOD FOR PRODUCING LAST, AND METHOD FOR PRODUCING SHOE UPPER

CROSS-REFERENCE TO RELATED APPLICATION

This application claims priority to Japanese Patent Applications No. 2019-229047 filed on Dec. 19, 2019 and No. 2020-084990, filed on May 14, 2020, the disclosures of which are incorporated herein by reference in their entirety.

FIELD OF THE INVENTION

The present invention relates to a last for shaping a shoe upper, a method for producing the last, and a method for producing the shoe upper.

BACKGROUND OF THE INVENTION

In producing custom-made shoes tailored to a user's feet, lasts are exclusive for the user. Thus, after shoe uppers are shaped using lasts to produce shoes, the lasts are no longer used unless stored for future use.

US 2018/0014609 A discloses that footwear is produced in a portable housing. US 2016/0206049 A discloses a last pre-form that is composed of a shape memory polymer and thereby re-shapeable. CN 109732913 A discloses that a last is formed by 3D printing.

However, none of the abovementioned prior art documents specifically and explicitly discloses reuse of lasts that are no longer used.

SUMMARY OF THE INVENTION

It is therefore an object of the present invention to provide a reusable last, a method for producing the last, and a method for producing a shoe upper.

The following presents a simplified summary of the invention disclosed herein in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

The present invention provides a last for shaping a shoe upper, the last including: at least an outer peripheral portion including an aggregate of a plurality of blocks, the plurality of blocks being joinable together and separable from each other.

The present invention further provides a method for producing a last for shaping a shoe upper, the method including forming the last by joining a plurality of blocks together to form an aggregate.

BRIEF DESCRIPTION OF DRAWINGS

The foregoing and other features of the present invention will become apparent from the following description and drawings of an illustrative embodiment of the invention in which.

DETAILED DESCRIPTION OF THE PREFERRED EMBODIMENT

An embodiment of the present invention will be exemplified with reference to the drawings. Hereinafter, regarding the term representing the direction "inward and outward direction", the inward direction is a direction toward a foot of a shoe wearer, and the outward direction is a direction toward the outside of the shoe. Further, when a description is given below on a shoe upper 2 before and after being shaped, the shoe upper 2 before being shaped can be referred to as an unshaped upper 2A while the shoe upper 2 after being shaped can be referred to as a shaped upper 2B for separate identification of the respective states.

Figure 2A:
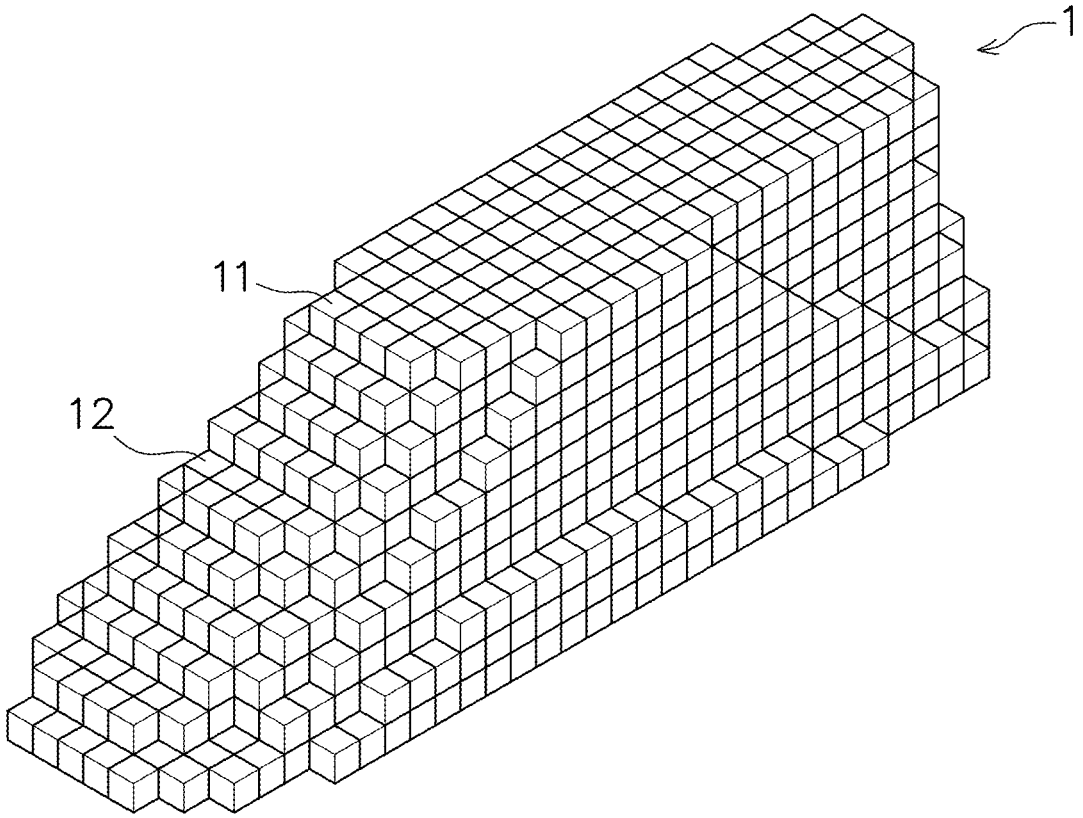
FIG. 2A is a top side perspective view showing a schematic configuration of the last.
Figure 2B:
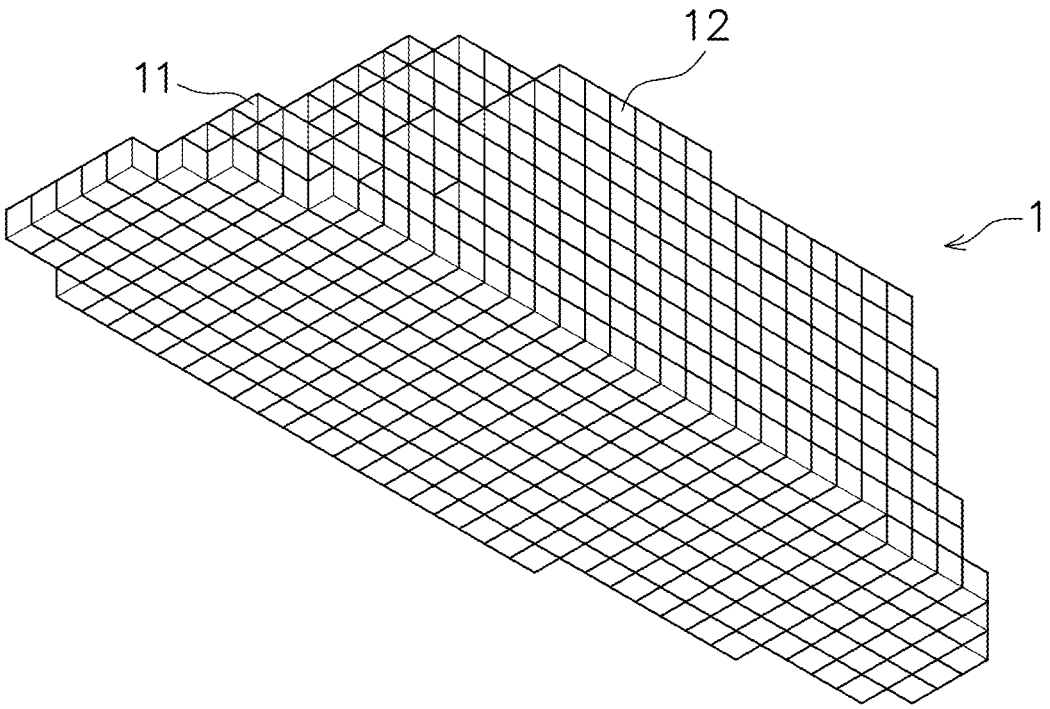
FIG. 2B is a bottom side perspective view showing a schematic configuration of the last.

A last (shoe last) 1 of this embodiment is mainly not a last for shoes for mass production, but a custom-made last 1 tailored to a user's foot F. However, the present invention does not intend to completely deny its application to a last for shoes for mass production, but can be applicable thereto. The last 1 can be produced at a shoe retailer, or can be produced at a factory located away from the retailer by transmission and reception of block joining data and data on a user's foot using a communication device, as will be described later. As shown in FIG. 2A and FIG. 2B, the last 1 of this embodiment has at least an outer peripheral portion (i.e., a portion coming into contact with the shoe upper 2 when the shoe upper 2 is shaped) including an aggregate of the plurality of blocks 11. In this embodiment, the last 1 includes a body 12 composed of the aggregate of the plurality of blocks 11. The aggregate of the plurality of blocks 11 is formed by joining the plurality of blocks 11 together by a human hand or a robot hand. The shoe upper 2 is, for example, formed of fabric, and in this embodiment formed of fabric composed of a heat-shrinkable fiber sheet.

Figure 3A:
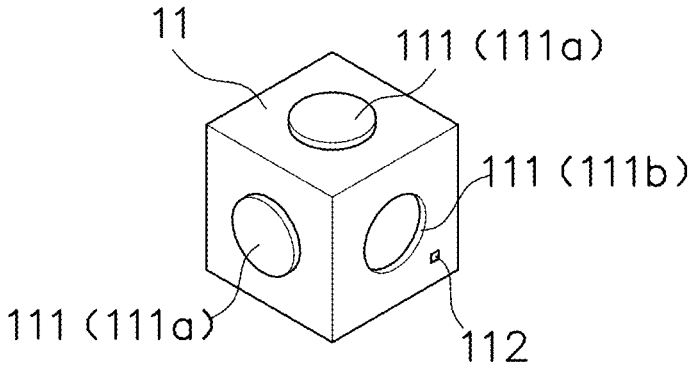
FIG. 3A is a perspective view showing an example configuration of a block.
Figure 3B:
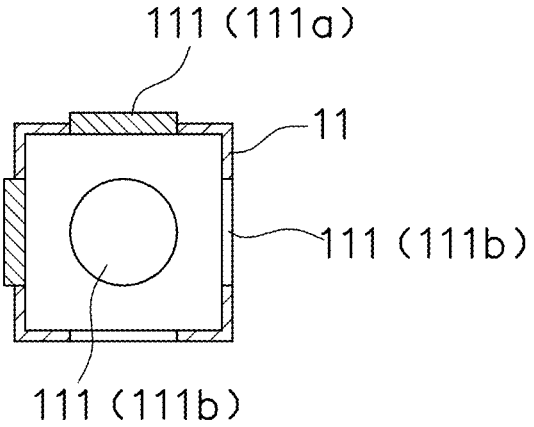
FIG. 3B is a vertical cross-sectional view showing an example configuration of a block.
Figure 3C:
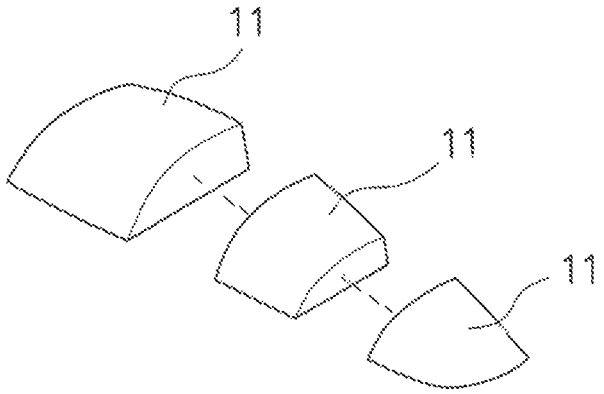
FIG. 3C is a perspective view showing examples of some blocks respectively having different shapes.

As shown in FIG. 3A, each of the plurality of blocks 11 of this embodiment has a cubic shape identical to each other. The material of the block 11 is not particularly limited, but can be any material such as a metal, a magnetic body, a resin, ceramic, timber, or paper. The block 11 can be solid, but for example can be hollow inside as shown in FIG. 3B, in terms of saving the weight of the last 1 composed of the aggregate of the plurality of blocks 11. In the case where the same material is used, the hollow block 11 can have a smaller weight than that of the solid block 11. The shape of the block 11 is not limited to the cubic shape as in this embodiment, and can be a rectangular parallelepiped shape (see FIG. 7), a truncated square pyramid shape, a wedge shape (i.e., a triangular shape in cross section), or a shape having a curved surface as shown in FIG. 3C. The block 11 having the curved surface is suitable for being arranged on the outermost part of the last 1 to obtain a smooth finish on the outer peripheral surface of the body 12. This configuration allows the surface of the last 1 to have a curved surface. In order to enable one block 11 to be stacked on another block 11, the surface of the one block 11 abutting the surface of the another block 11 at the time of the stacking is preferably a surface suitable for the stacking, such as a flat surface. The plurality of blocks 11 are not necessarily arranged tightly without a clearance, but may be arranged with a clearance formed between each adjacent two of the plurality of blocks 11. The clearance may be provided on the outermost part of the last 1.

Figure 12:
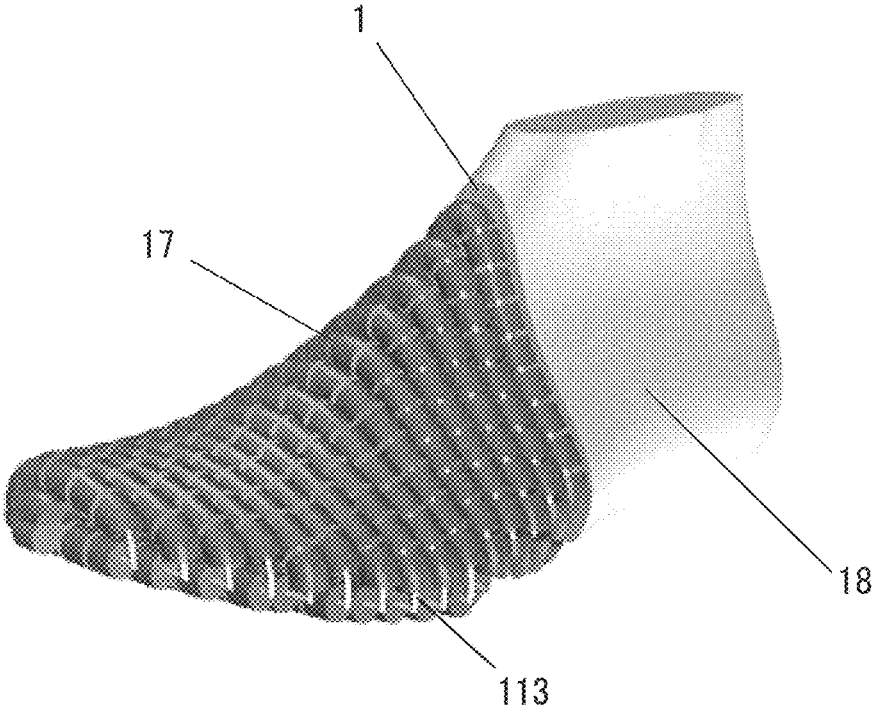
FIG. 12 is a perspective view showing a last according to another embodiment of the present invention.
Figure 13A:
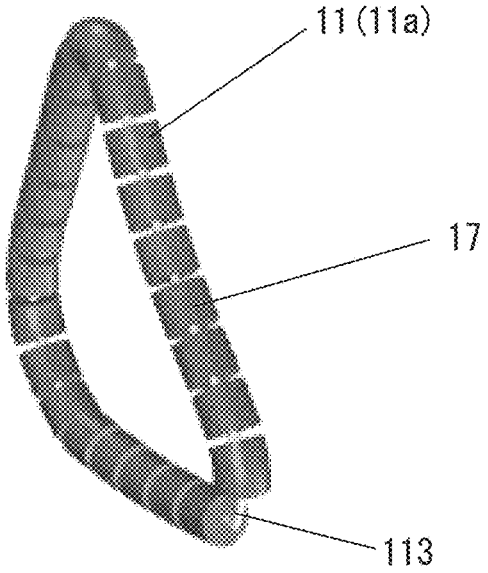
FIG. 13A is a perspective view showing an aggregate of a plurality of beads that are connected together in an annular form and constitute the last in FIG. 12.

The plurality of blocks 11 are configured to be joinable together and separable from each other. As a joining device, various devices can be used, such as a recess and projection fitting device or a magnet. As shown in FIG. 12 and FIG. 13A, a wire 113 can be used as the joining device for connecting together a plurality of beads 11*a*, which serve as the plurality of blocks 11, into an annular form. In the example shown in FIG. 3A, a recess and projection fitting device 111 is provided on each surface of the cubic block 11 (not shown in other Figures). The recess and projection fitting device 111 can be, for example as illustrated, a combination of a projection 111*a* projecting from a surface of the cubic block 11 and a recess 111*b* such as a through hole formed in another surface of the cubic block 11. Each adjacent two blocks 11 can be joined together when a projection 111*a* of one of the each adjacent two blocks 11 is fitted into a recess 111*b* of the other block 11. In the case where magnets are used although not shown, the magnets provided on the opposed surfaces of each adjacent two blocks 11 need to have opposite polarity to each other, so as to be attracted to each other. Alternatively, the configuration needs to be such that a surface of one of the each adjacent two blocks 11 has a magnet while a surface of the other block 11 has a magnetic body (steel) that attracts the magnet.

Each of the plurality of blocks 11 can have at least an outer peripheral surface formed of a material of high heat conductivity. For example, the outer peripheral surface can be a surface with a metal (e.g. an aluminum alloy) exposed. In this case, the surface of the metal material may be exposed to the outer peripheral surface, or a metal layer may be formed on the outer peripheral surface by plating or coating. The material of high heat conductivity is used to form the outer peripheral surface, which is a portion directly in contact with the shoe upper 2 unless a cover part 15 is provided on a body 12 of the last 1 as will be described later. This configuration allows heat to be easily transferred to the shoe upper 2 particularly in the case where the shoe upper 2 having heat-shrinkability is shaped.

Figure 7:
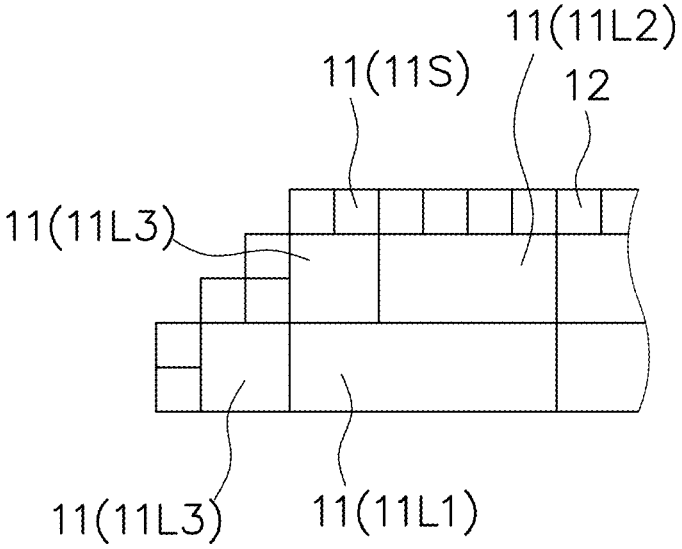
FIG. 7 is a side view showing a part of a combination of large and small blocks for a last according to another embodiment of the present invention.

The plurality of blocks 11 may have different shapes. In this case, the plurality of blocks 11 have different sizes, as shown, for example, in FIG. 7. Among these, relatively large blocks in this embodiment are constituted by three kinds, namely: blocks 11L1 having a long rectangular parallelepiped shape; blocks 11L2 having a short rectangular parallelepiped shape; and blocks 11L3 having a cubic shape. The number of kinds of blocks is not particularly limited, and there may be two or more kinds (at least one kind each of relatively large blocks and relatively small blocks). The shapes of the individual blocks 11 to be combined are not particularly limited, either. As shown in FIG. 7, the relatively large blocks 11L1 to 11L3 can be arranged on an inner side of the body 12 while relatively small blocks 11S can be arranged on an outer side thereof. This configuration allows the large blocks 11L1 to 11L3 to be used for roughly shaping the inner side of the body 12, and then allows the small blocks 11S to be used for finely shaping the outer side of the body 12. Thus, the body 12 can be efficiently shaped as compared with, for example, the case where the body 12 is shaped using only the small blocks 11S. Further, the small blocks 11S arranged on the outer side of the body 12 allow the last 1 to be more finely shaped than the large blocks 11L1 to 11L3.

Another example of the case where the plurality of blocks 11 have different shapes can be such that the relatively small blocks 11S are arranged at a portion of the last 1 corresponding to a forefoot portion of a user's foot, the shape of which is likely to vary by user, while the relatively large blocks 11L1 to 11L3 are arranged at other portions. Still another example may be such that the relatively small blocks 11S are arranged around a portion of the last 1 corresponding to a wearing opening of the shoe upper 2 while the relatively large blocks 11L1 to 11L3 are arranged at other portions. Each of these examples may be combined with the aforementioned configuration in which the relatively large blocks 11L1 to 11L3 are arranged on the inner side of the body 12 while the relatively small blocks 11S are arranged on the outer side thereof.

Figure 11:
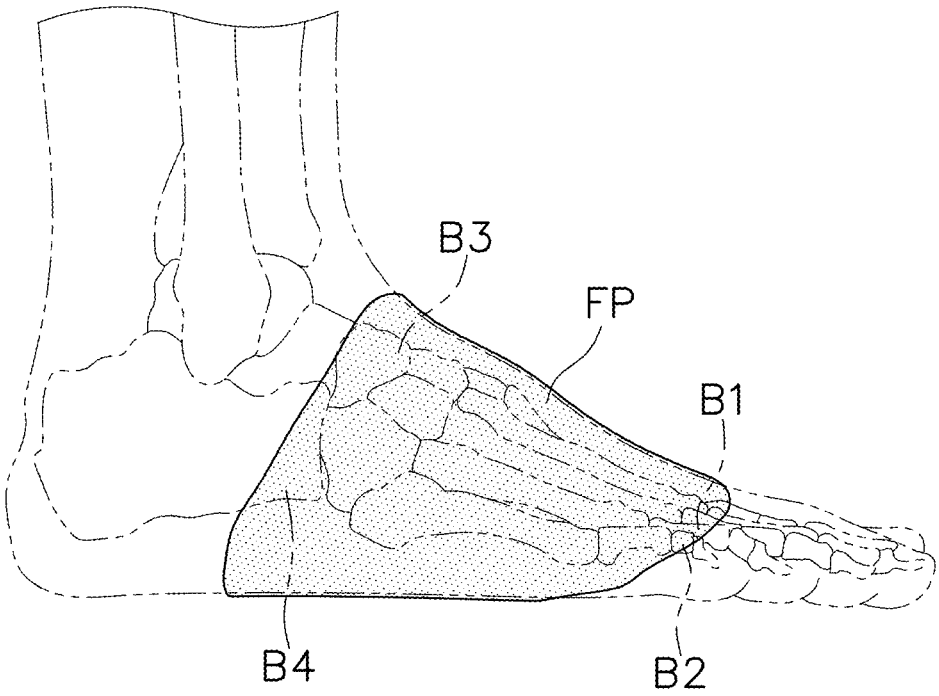
FIG. 11 is a side view showing a relationship between a forefoot portion (shown by solid line) and a structure of human foot anatomy (shown by two-dotted chain line).

The "forefoot portion" herein is intended to be a portion of the human (wearer's) foot anatomy as encircled in FIG. 11, that is, an area from the proximal phalanges B1 of the toes (the middle phalanx B2 for the fifth toe) to the anterior parts of the talus B3 and the calcaneus B4. A portion of the shoe upper 2 corresponding to the forefoot portion FP is an important portion because it gives great influence on the feeling of wearing or the athletic performance of the wearer. Thus, forming the forefoot portion FP by arranging the relatively small blocks 11S can produce a significant effect responsive to the aforementioned influence. The "wearing opening" is intended to be an opening of a shoe through which the wearer places his or her foot into or out of the shoe. The wearing opening is also an important portion because it has great influence on the feeling of wearing of the wearer. Thus, forming the portion of the wearing opening by arranging the relatively small blocks 11S can produce a significant effect responsive to the aforementioned influence.

In the case where the plurality of blocks 11 have different shapes, each block 11 can have an identifier 112 for allowing its shape to be externally identifiable, as shown in FIG. 3. When each block 11 has the identifier 112, it becomes easy to sort the blocks 11 by shape (including size) or join together the blocks 11 having the same shape. The identifier 112 can also be used to identify the position or orientation of the block 11, such as a direction in which a stacking surface of the block 11 faces. Examples of the identifier 112 include an IC chip and a two-dimensional code. Further, the identifier 112 can be a color, a surface pattern, or a partial change in shape (e.g., a recess or a projection, a notch, a through hole) that is image-identifiable (i.e., by human visual observation or mechanical observation).

The last 1 configured as above can be disassembled back into the plurality of individual blocks 11 after being used for shaping the shoe upper 2. Thereafter, the plurality of blocks 11 can be reassembled to form the aggregate. This allows the last 1 to be reusable. The last 1 is not essentially disassembled into the individual blocks 11, and may be disassembled into a plurality of aggregates each formed of a plurality of blocks 11 connected together.

Figure 4:
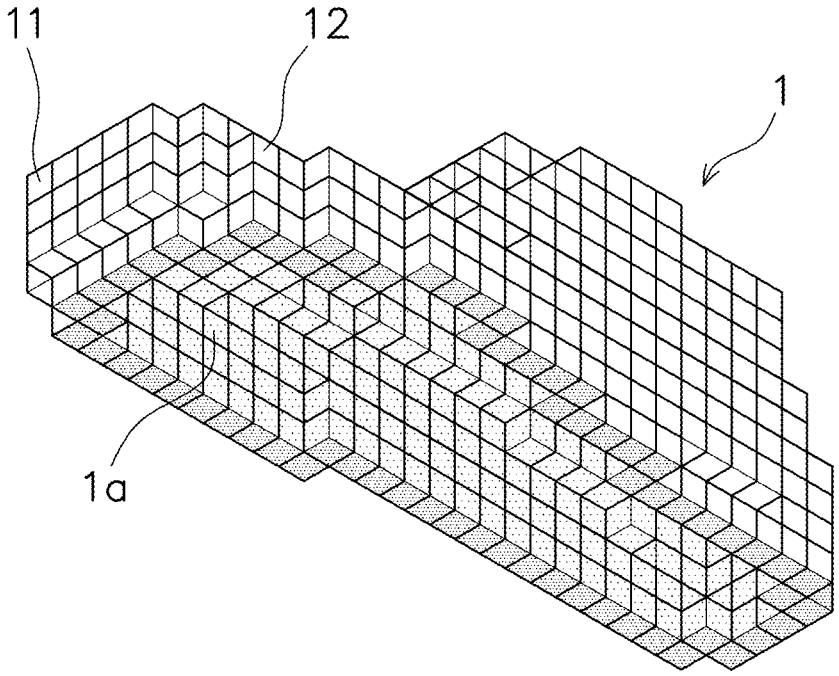
FIG. 4 is a bottom side perspective view showing a schematic configuration of a last according to another embodiment of the present invention, the last having a hollow portion thereinside. For ease of viewing, the bottom portion of the last is illustrated by the dark-shaded area while the internal surface of the hollow portion is illustrated by the light-shaded area.
Figure 5:
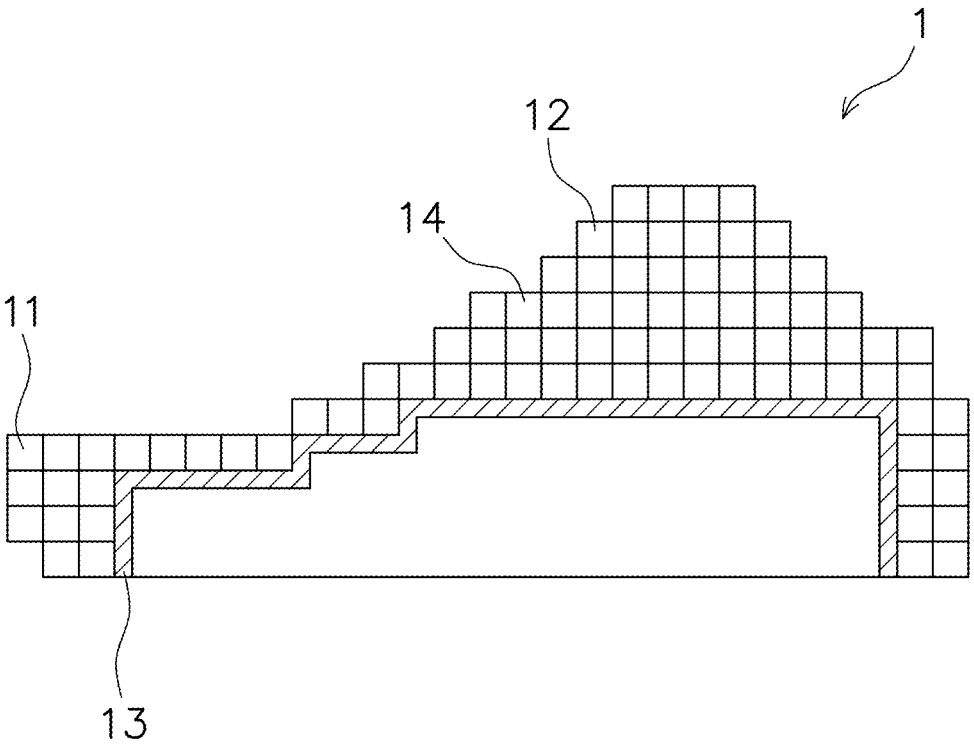
FIG. 5 is a vertical cross-sectional view showing a schematic configuration of a last according to another embodiment of the present invention, the last having a central part and a peripheral part.

The last 1 may be solid, but is preferably hollow inside, as shown in FIG. 4 or FIG. 5. In the case where the last 1 is formed to be hollow, the body 12 is formed of an aggregate of a plurality of blocks 11 that surrounds an internal space 1*a*, which corresponds to a hollow portion of the last 1. The example shown in FIG. 4 or FIG. 5 has the internal space 1*a* that is open on its bottom side, without limitation thereto. The internal space 1*a* may be closed by a plurality of blocks 11 arranged over the entire periphery of the internal space 1*a*. The last 1 formed to be hollow can still ensure the strength by allowing the body 11 to have a certain thickness, and thus has no functional problem. The last 1 formed to be hollow eliminates the necessity to arrange blocks 11 in the center portion of the last 1, and can thus reduce the number of blocks 11 constituting the last 1 by the number equivalent to the volume of an internal portion. The last 1 thus formed can save the material. This configuration can also save the time required for forming the last 1 (shaping time). Further, this configuration can save the weight of the last 1, and therefore allows the last 1 to be easily handled. As described above, this configuration has various advantages.

As shown in FIG. 5, the last 1 can include a central part 13 and a peripheral part 14. The central part 13 is formed in advance as a core member of the last 1. The central part 13 may be solid or hollow. The central part 13 formed to be hollow as shown in FIG. 5 can save the weight of the last 1. The peripheral part 14 is formed on an outer peripheral portion of the central part 13. The peripheral part 14 is constituted by an aggregate of a plurality of blocks 11. That is, in this configuration, the central part 13 is positioned in the internal space 1*a* in the aforementioned configuration. The last 1 configured as above can reduce the number of blocks 11 constituting the last 1 by the number equivalent to the volume of the internal portion, and can thus save the time required for forming the last 1 (shaping time), similar to the aforementioned configuration. This configuration can reduce the amount of the blocks 11 used for forming the last 1 as compared with the configuration in which the last 1 is solid and entirely formed in a uniform manner. In the case where shoes are produced at a factory, use of the central part 13 as a core material allows only the central part 13, which is slightly smaller than the last 1, to be stored in the factory for a long period of time. Thus, the number of central parts 13 stored per specific space can increase as compared with the case where the lasts 1 are entirely stored, and the storage space can be thereby saved. Even when the lasts 1 of different sizes are required, their central parts 13 can be made to have the same shape (size) so that the necessity to store the lasts 1 by size is eliminated. That is, the central parts 13 can have the same shape (size) irrespective of who are the shoe wearers when the central parts 13 are constituted respectively by portions having a common volume regardless of the shoe wearer's physical constitution.

Figure 6:
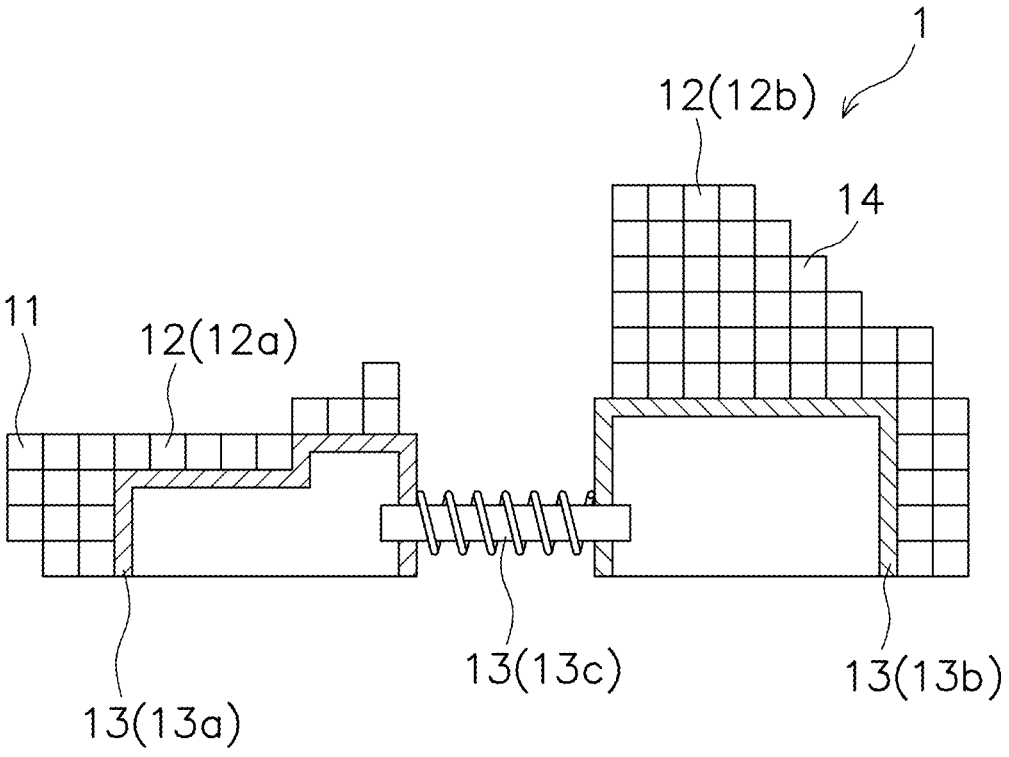
FIG. 6 is a vertical cross-sectional view showing a schematic configuration of a last according to another embodiment of the present invention, the last having a central part and a peripheral part, and the last being divided into a fore portion and a hind portion.

The central part 13 may have a fixed shape as shown in FIG. 5, or may be, for example, configured to have a screw or the like to allow the dimension in a front and back direction (longitudinal direction) of the central part 13 to be adjustable, like a shoe tree (sometimes called a "shoe keeper" in Japan). Specifically, as shown in FIG. 6, the central part 13 can be configured to be divided into a front part 13*a* provided on the front side and a back part 13*b* provide on the back side, with reference to the front and back direction of a shoe when worn. In this configuration, the central part 13 can further include an axial member 13*c* provided with a screw, a spring, or the like, the axial member 13*c* arranged between the front part 13*a* and the back part 13*b* so as to be capable of extending and shortening in the front and back direction and being fixed at a desired length. This configuration allows the body 12 of the last 1 to be divided into a forefoot part 12*a* and a hindfoot part 12*b*. A portion (midfoot part) between the forefoot part 12*a* and the hindfoot part 12*b* may be constituted only by the axial member 13*c* with no block 11 provided therein as shown in FIG. 6, or may have a plurality of blocks 11 provided after the extended or shortened state of the axial member 13*c* is fixed.

In the case where the last 1 includes the central part 13, the peripheral part 14 can be formed of a material of higher heat conductivity than that of the central part 13. For example, the plurality of blocks 11 constituting the peripheral part 14 can be formed of metal (e.g., an aluminum alloy) while the central part 13 can be formed of a heat-resistant resin (for example a resin resistant to heat of 200° C. or higher). This configuration causes the peripheral part 14 of the last 1 to be heated when the shoe upper 2 is heated for shaping (see FIG. 10), and thereby allows the shoe upper 2 to be heated also from the side of the last 1 (that is, the unshaped upper 2A is to be heated from both inside and outside). This configuration can thus shorten the heating time compared to the case where heating is performed only from outside, and allows the shoe upper 2 to be shaped efficiently (i.e., within a short time).

Figure 8:
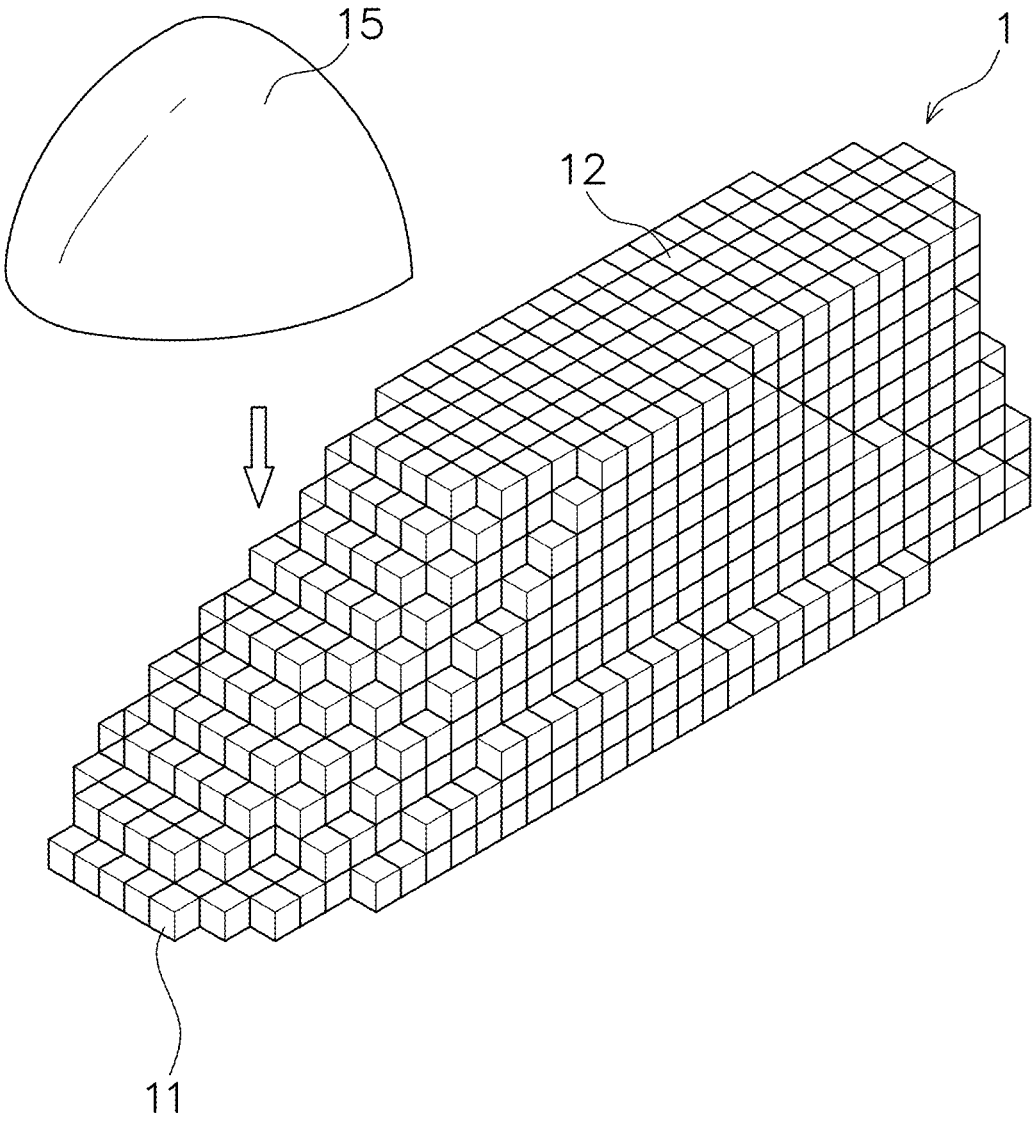
FIG. 8 is a perspective view showing a configuration in which a cover part is provided on an aggregate of a plurality of blocks, as a last according to another embodiment of the present invention.

The aggregate of the plurality of blocks 11 constituting the outer peripheral portion may be at least partially covered with a sheet-shaped or a plate-shaped cover part 15 from outside. The material of the cover part 15 is not particularly limited, and can be, for example, the same material as that of the blocks 11. The cover part 15 can, for example, have a shape having a curved surface, as shown in FIG. 8. The cover part 15 configured as above is attached to the body 12 to fill the steps or gaps among the aggregate of the plurality of blocks 11, the steps or gaps being caused by connecting each adjacent blocks 11. That is, the cover part 15 can arrange the outer peripheral shape of the last 1. This configuration allows the shoe upper 2 to be shaped into a desired form. The cover part 15 may be of a single piece, or may be constituted by a plurality of pieces combined and integrated together.

Figure 9:
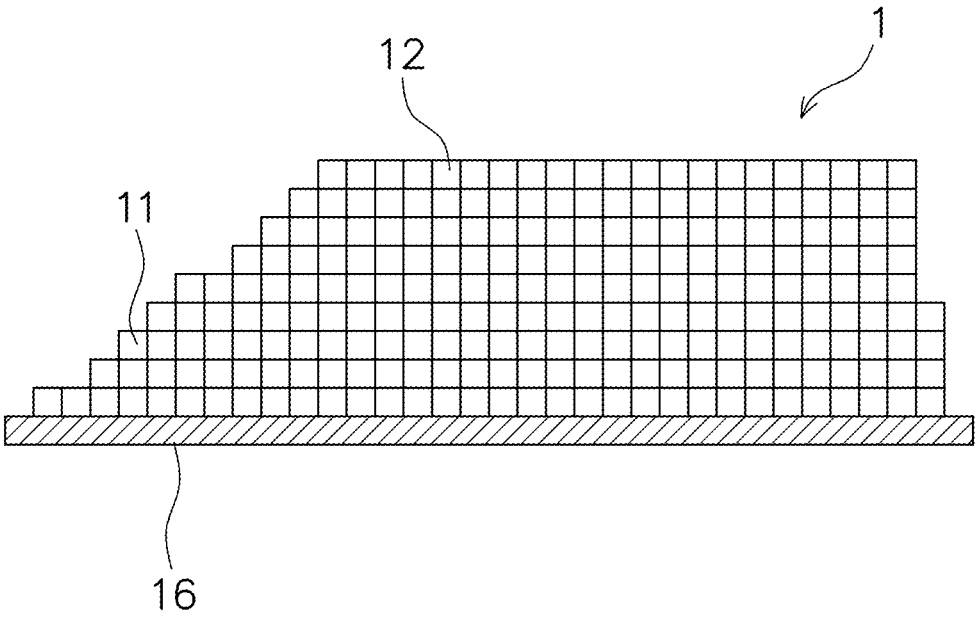
FIG. 9 is a side view showing a schematic configuration of a last in which a base part is combined with an aggregate of a plurality of blocks, according to another embodiment of the present invention.

As shown in FIG. 9, the last 1 may include a plate-shaped base part 16, and an aggregate of a plurality of blocks 11 arranged on the upper side of the base part 16. The base part 16 functions to shape a lower part of the shoe upper 2. The use of the base part 16 allows the lower part of the shoe upper 2 to be shaped into a constant form, as compared with the configuration in which the aggregate of the plurality of blocks 11 is exposed on the bottom side of the last 1. This configuration allows the lower part of the shoe upper 2 to be shaped into a desired shape in conformity with the shape of a sole (specifically, the shape of the upper surface of a sole). In order to form the lower part of the shoe upper 2 in conformity to the shape of the sole, the shape of the lower part (lower surface) of the last 1 is naturally determined. Therefore, the last 1 can be formed more efficiently when the lower part of the last 1 is formed by, for example, using the base 16 formed of a single, unified piece than when it is formed by arranging a plurality of blocks 11.

FIG. 9 is a simplified view illustrating the configuration of the last 1 provided with the base part 16, and the form of the base part 16 is not limited to the illustrated form. Since the shoe upper 2 is formed to conform to the shape of the upper surface of a midsole, the base part 16 generally has a relatively complicated plate shape rather than a flat plate shape. Thus, the base part 16 may have an uneven surface to, for example, allow its upper surface to integrally have the blocks 11. Further, the bottom surface of the base part 16 is generally constituted by an uneven surface or a curved surface, rather than a flat surface.

Next, a method for producing the last 1 will be described. The last 1 is formed by joining the plurality of blocks 11 together into the aggregate. Thus, the last 1 can be easily formed without use of a forming mold as compared with, for example, the case where the last is formed of a resin material.

Before the last 1 is formed, a data acquiring step of acquiring the user's foot shape data, and a data generating step of generating block joining data from the user's foot shape data acquired are performed. Thereafter, a last forming step of joining the plurality of blocks 11 together based on the generated block joining data is performed. Performing these steps enables forming the custom-made last 1 tailored to the user's foot F.

The block joining data is created based on the user's foot shape data, which is individually generated for each of a plurality of users. The block joining data thus generated allows the shoe upper 2 to be finely customized for each user. The block joining data includes information on how the blocks 11 are to be stacked on each other. In the case where the plurality of blocks 11 having different shapes (including sizes) are used, the block joining data includes information on which shape (size) of the blocks 11 are used and at which position of the last 1 those blocks 11 are arranged.

The last forming step is performed by joining the plurality of blocks 11 by a human hand or a robot hand. In the case where the last forming step is performed particularly by a robot hand, a sensor or a camera reads the identifier 112 of each block 11, and a controller configured to control the robot hand thereby recognizes the shape (size) and position or orientation of the block 11. In the case where the cover part 15 is provided as shown in FIG. 8, the cover part 15 is attached in the last forming step to at least partially cover the aggregate of the plurality of blocks 11. In the case where the base part 16 is provided as shown in FIG. 9, the aggregate of the plurality of blocks 11 is formed on the upper side of the base part 16 in the last forming step.

Figure 1A:
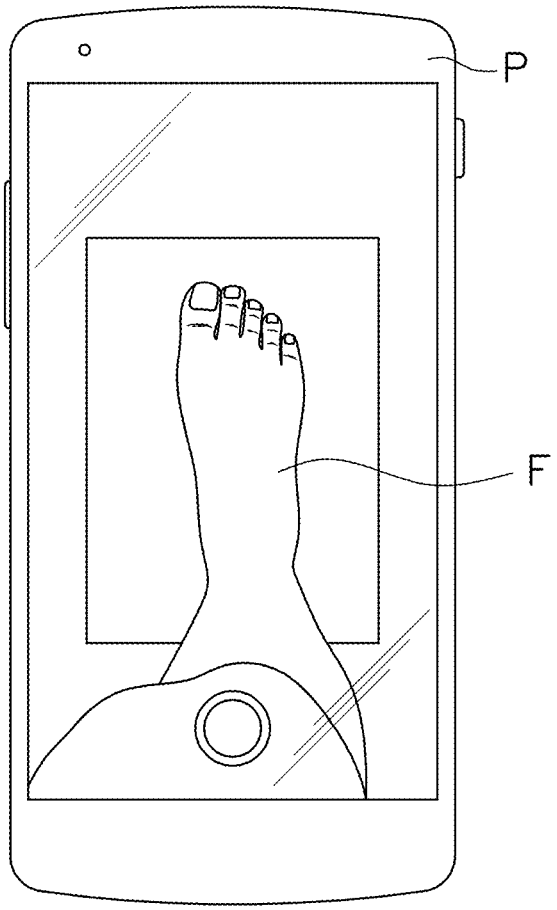
FIG. 1A shows a state where an image of a user's foot is being captured to obtain the user's foot shape data for a last according to one embodiment of the present invention.
Figure 1B:
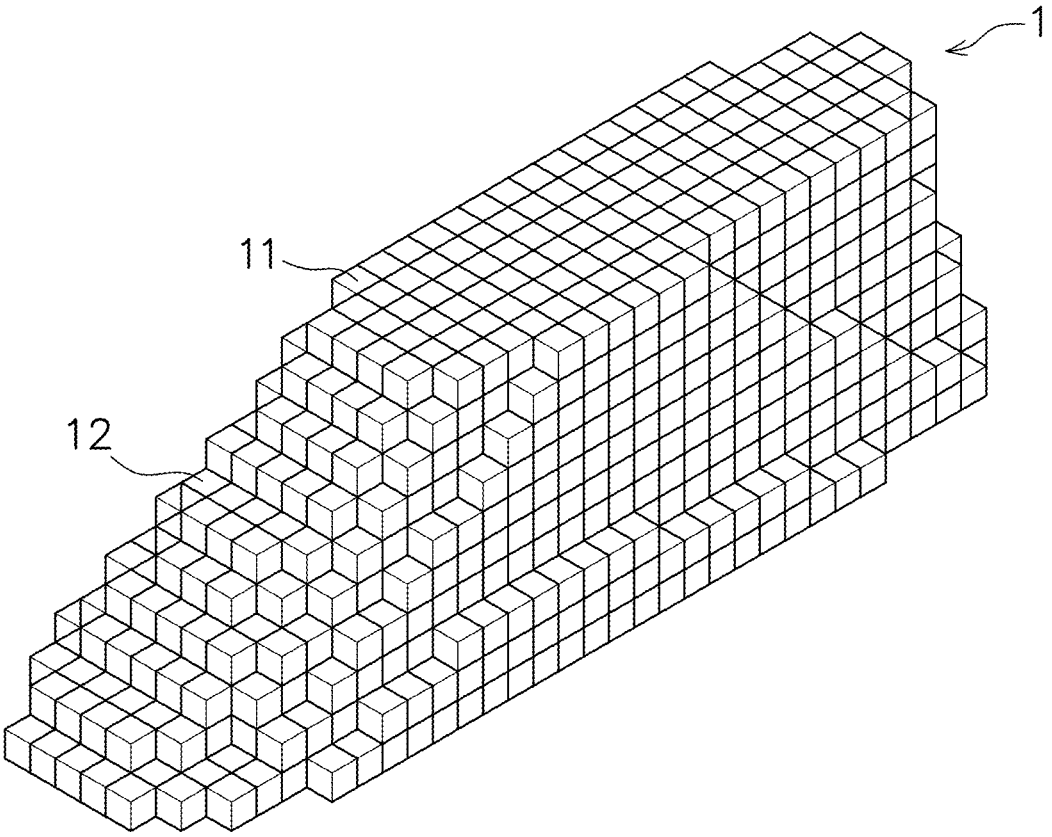
FIG. 1B is a perspective view of the last.
Figure 1C:
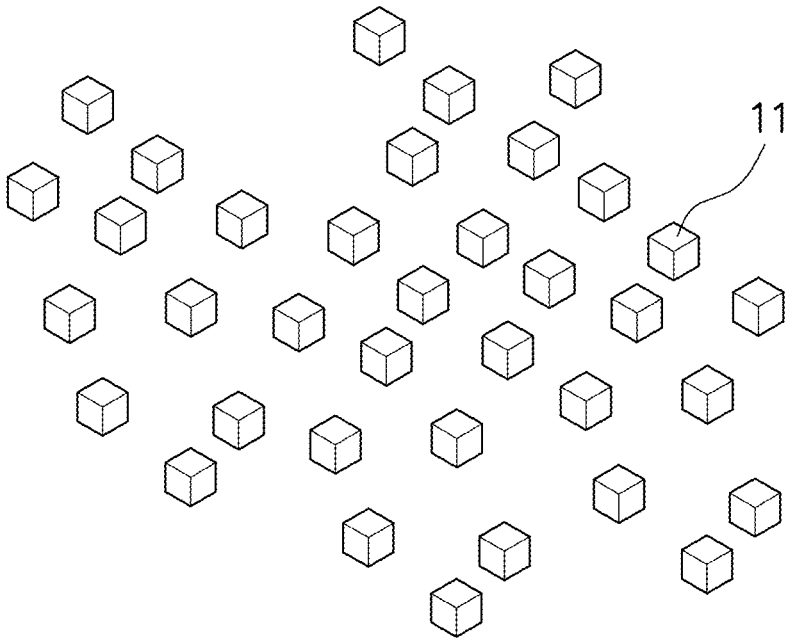

The user's foot shape data refers to, for example, measurement data of each part of the user's foot F generated from image data obtained by capturing an image of the user's foot F as shown in FIG. 1A. Thus, the user's foot shape data can be easily generated using, for example, a digital camera or a smartphone P (see FIG. 1A). In the case, for example, where the smartphone P is used, the foot shape data can be generated based on the image data by software that is installed in advance in the smartphone P. The foot shape data can also be created by calculation using both the captured image data and data owned by a shoemaker in their server.

The image data can be acquired at the user's home or at a retailer (dealer) the user visits. In this case, the image data is transmitted to the server of a shoemaker and the foot shape data is generated at a factory of the shoemaker, so that the lasts 1 and shoes conforming thereto can be subsequently produced at the factory. It is also possible to acquire the image data at a retailer and produce the lasts 1 and shoes conforming thereto at the retailer. It is of course possible to produce the lasts 1 and shoes conforming thereto respectively at different places. The retailer is not limited to a fixed store but may be a mobile store using a car or a trailer.

A disassembling step is performed when the last 1 is no longer required after being used for shaping the shoe upper 2. In the disassembling step, the aggregate of the plurality of blocks 11 constituting the last 1 after being used is disassembled into individual blocks 11 or into small-unit aggregates each having a smaller number of blocks 11 than that of the aforementioned aggregate. The disassembling step can be performed by a human hand or a robot hand. A device configured to unjoin the blocks 11 by applying impact on the aggregate of the plurality of blocks 11 or by demagnetizing the blocks 11 in the case where they are joined together by magnetic force can also be used. Performing the disassembling step as described above allows the plurality of disassembled blocks 11 or the small-unit aggregates to be reused to produce a new last 1. The last 1 after being used can be thus reused as a last 1 for another user.

Figure 10:
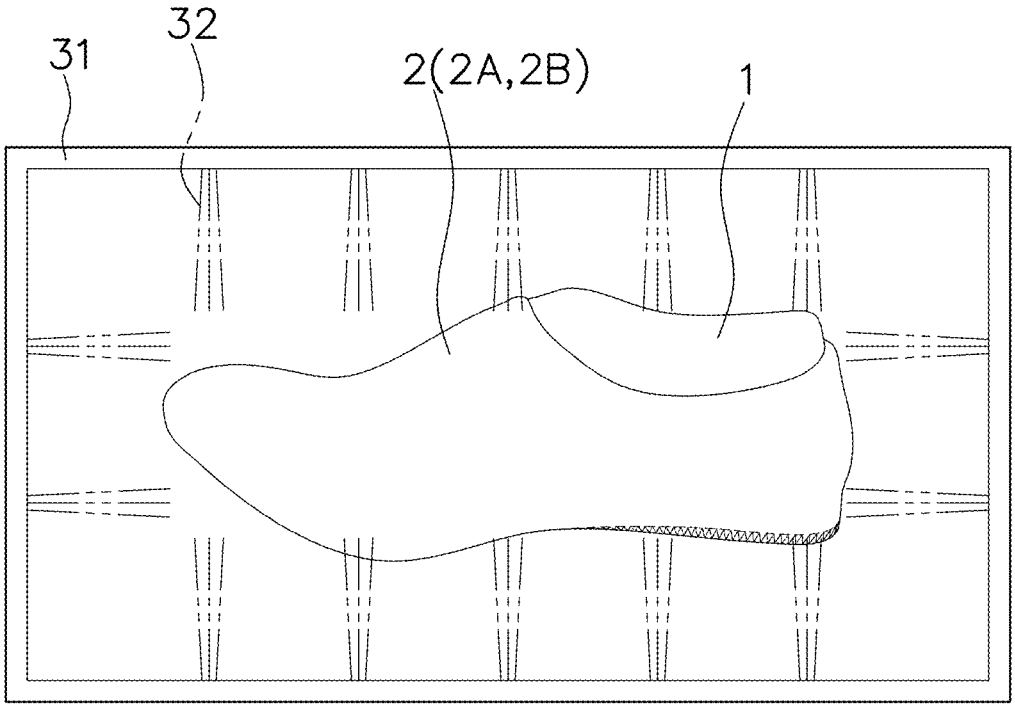
FIG. 10 is a side view showing a state where an unshaped upper is placed on the last (with its shape schematically shown) and subjected to steam-heating in a heating box.

Next, a method for producing the shoe upper 2 using the last 1 will be briefly described. For example, a material of the shoe upper 2 (i.e., the unshaped upper 2A) composed of a fiber sheet including heat-shrinkable yarns is prepared. Then, carried out are a first shaping step of placing the unshaped upper 2A on the last 1, and a second shaping step of shaping the unshaped upper 2A in conformity with the shape of the last 1 by heating to obtain the shaped upper 2B as shown in FIG. 10. A steam heating means is used as a heating means in the second shaping step. As schematically shown in FIG. 10, for example, the unshaped upper 2A is placed in a heating box 31, and heated with high-temperature steam 32 discharged from the inner surface of the heating box 31. This steam heating allows the unshaped upper 2A to be entirely and uniformly heated. This configuration allows the unshaped upper 2A to be uniformly deformed in conformity with the shape of the last 1 to obtain the shaped upper 2B. In the second shaping step, hot-air heating, hot water heating, or the like can be used other than the steam heating. Further, the unshaped upper 2A can be heated not entirely but partially.

Performed after the second shaping step is a sole attaching step, in which the shaped upper 2B is attached to a separately prepared sole by, for example, adhesive. Other than adhesive, heat fusion bonding, for example, can be applied to perform the sole attaching step simultaneously with the second shaping step. In this case, the heat fusion bonding can be efficiently performed using the last 1 having the central part 13 formed of a material of high heat conductivity (for example, a metal such as aluminum, copper, or stainless steel). Forming a shoe tongue, trimming a wearing opening, making eyelets for passing shoelace therethrough, attaching decoration members and tags, printing a logo, and attaching an insole can be performed as appropriate, during any of the aforementioned steps or after all the steps.

Hereinafter, the configurations and operational effects according to the embodiment of the present invention will be summarized. Provided in this embodiment is a last 1 for shaping a shoe upper 2, the last 1 including: at least an outer peripheral portion including an aggregate of a plurality of blocks 11, the plurality of blocks 11 being joinable together and separable from each other.

This configuration allows the aggregate to be disassembled into the individual blocks 11 after the shoe upper 2 is shaped, thereby allowing the last 1 to be reusable.

The last 1 can have a hollow interior.

This configuration can reduce the number of blocks 11 constituting the last 1 by the number equivalent to the volume of an internal portion of the last 1, thereby enabling the shaping time of the last 1 to be shortened.

The last 1 can further include: a central part 13 formed in advance as a core; and a peripheral part 14 that is constituted by the aggregate of the plurality of blocks 11 formed on an outer peripheral portion of the central part 13.

This configuration can reduce the number of blocks 11 included in the last 1, thereby enabling the shaping time to be shortened.

Each of the plurality of blocks 11 can have at least an outer peripheral surface formed of a material of high heat conductivity.

This configuration allows heat to be easily transferred to the shoe upper 2 particularly in the case where the shoe upper 2 having heat-shrinkability is shaped.

The configuration can be such that the plurality of blocks 11 include blocks 11 of different shapes, and that each of the blocks 11 of different shapes has an identifier 112 for allowing a shape of the each of the blocks 11 of different shapes to be externally identifiable.

This configuration makes it easy to sort the plurality of blocks 11 by shape or to join together the blocks 11 having the same shape.

The configuration can be such that the plurality of blocks 11 include blocks 11 of different sizes, and that relatively large blocks 11L1 to 11L3 are arranged on an inner side of the last 1 and relatively small blocks 11S, which are smaller than the relatively large blocks 11L1 to 11L3, are arranged on an outer side of the last 1.

This configuration allows the large blocks 11L1 to 11L3 to be used for roughly shaping the inner side of the last 1, and then allows the small blocks 11S to be used for finely shaping the outer side of the last 1.

Each of the plurality of blocks 11 can have a hollow interior.

This configuration can save the weight of the last 1.

The aggregate of the plurality of blocks 11 can have an outer peripheral portion at least partially covered by a sheet-shaped cover part 15 or a plate-shaped cover part 15 from outside.

This configuration allows the cover part 15 to be used for arranging the outer peripheral shape of the last 1.

The configuration can be such that the aggregate of the plurality of blocks 11 is provided on an upper side of a plate shaped base part 16 for shaping a lower part of the shoe upper 2.

This configuration allows the lower part of the shoe upper 2 to be shaped into a constant shape by using the base part 16.

Provided in this embodiment is a method for producing a last 1 for shaping a shoe upper 2, the method including: forming the last 1 by joining a plurality of blocks 11 together to form an aggregate.

This configuration allows the last 1 to be easily formed without a use of a forming mold.

The method for producing the last 1 can further include: acquiring a user's foot shape data; generating block joining data from the user's foot shape data; and joining the plurality of blocks 11 together based on the block joining data to form the last 1.

The production method thus configured allows the last 1 to be formed tailored to the user's foot.

The method for producing the last 1 can further include creating the block joining data based on the user's foot shape data individually generated for each of a plurality of users.

The production method thus configured allows the shoe upper 2 to be customized for each user.

The user's foot shape data can be generated from image data obtained by capturing an image of the user's foot.

The production method thus configured allows the foot shape data to be easily generated using, for example, a digital camera or a smartphone P.

The method for producing the last 1 can further include: disassembling the last 1, after being used, into the plurality of blocks 11.

The production method thus configured allows the last 1 after being used to be reusable as a last 1 for another user.

Provided in the aforementioned embodiment is a method for producing a shoe upper 2, including: placing an unshaped upper 2A on the last 1, the unshaped upper 2A composed of a fiber sheet including heat-shrinkable yarns; and shaping the unshaped upper 2A in conformity with the shape of the last 1 by heating to obtain a shaped upper 2B.

The production method thus configured allows the shoe upper 2 to be produced using a reusable last 1.

The present invention has been described by taking an embodiment, but the description is merely an exemplification. The last 1, the method for producing the last 1, and the method for producing the shoe upper 2, according to the present invention, are not limited to the aforementioned embodiment. Thus, various modifications can be made for the last 1, the method for producing the last 1, and the method for producing the shoe upper 2, according to the present invention, without departing from a gist of the present invention. The modifications include, for example, partially replacing or partially omitting a plurality of elements constituting the aforementioned embodiments, and combining an element pertaining to an embodiment with an element pertaining to another embodiment as appropriate. The modifications also include combining matters pertaining to common technical knowledge regarding the last 1, the method for producing the last 1, and the method for producing the shoe upper 2.

Figure 13B:
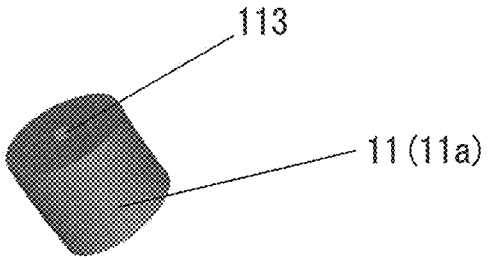
FIG. 13B is a perspective view of one of the plurality of beads constituting the last in FIG. 12.
Figure 13C:
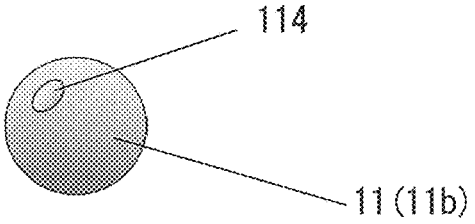
FIG. 13C is a perspective view showing an example of another form of the bead.

For example, the configuration can be such that each block 11 is a cylindrical bead 11*a* having a through hole 114 as shown in FIG. 13B, or is a spherical bead 11*b* having a through hole 114 as shown in FIG. 13C. For example, a plurality of cylindrical beads 11*a* are connected together with a wire 113 passing through the through holes 114 of the respective beads 11*a* to form an annular body 17 as shown in FIG. 13A. The wire 113 may be a cord capable of retaining its shape, such as metal wire, or may be a soft cord such as thread.

As shown in FIG. 12, a plurality of annular bodies 17 each formed to conform to the shape of the corresponding portion of the last 1 are combined to form the last 1. In the example shown in FIG. 12, the hind portion of the last 1 has a constant form, and the fore portion thereof has a base part 18 around which the annular bodies 17 can be wound. A combination of the base part 18 and each block 11 (each bead 11*a* in this case) allows a specific portion of the last 1 to be easily formed in conformity to the shape of the corresponding portion of the user's foot F. Although not shown, the annular bodies 17 may be wound around the hind portion of the last 1 (i.e., a portion corresponding to the heel of the user's foot F), or may be wound around the entire portion of the last 1.

The last 1 may be formed to entirely conform to the shape of the user's foot F, but may be formed to have a specific portion having a desired dimension inconsistent with the shape of the user's foot F for design or functional reasons.

The method for producing the shoe upper 2 is not limited to the aforementioned embodiment in which the fiber sheet including heat-shrinkable yarns are heat-shrunk, but various methods such as: knitting yarns to form fabric surrounding the last 1; or layering a material using a 3D printer can be employed.

The last, the method for producing the last, and the method for producing the shoe upper, of this embodiment are as described above, but the present invention is not limited to the aforementioned embodiment, and the design can be appropriately modified within the scope intended by the present invention. The operational advantages of the present invention are also not limited to the foregoing embodiments. The embodiments disclosed herein should be construed in all respects as illustrative but not limiting. The scope of the present invention is not indicated by the foregoing description but by the scope of the claims. Further, the scope of the present invention is intended to include all the modifications equivalent in the sense and the scope of the claims.

What is claimed is:

1. A last for shaping a shoe upper, the last comprising:

at least an outer peripheral portion comprising an aggregate of a plurality of blocks, the plurality of blocks being joinable together to form a portion of the last and shape the shoe upper, and separable from each other after being joined together; and a cover part attached to the plurality of blocks and shaped to fill steps or gaps among the aggregate of the plurality of blocks caused by connecting adjacent ones of the blocks, to form an outer peripheral shape of the last, the outer peripheral shape of the last including a curved surface disposed over the steps or gaps;

wherein the plurality of blocks includes a first plurality of blocks which are identical to each other.

2. The last according to claim 1, wherein the last has a hollow interior.

3. The last according to claim 2, further comprising:

a central part formed in advance as a core; and a peripheral part that is constituted by the aggregate of the plurality of blocks formed on an outer peripheral portion of the central part.

4. The last according to claim 2, wherein each of the plurality of blocks has at least an outer peripheral surface formed of a material of high heat conductivity.

5. The last according to claim 2, wherein the plurality of blocks include blocks of different shapes, and each of the blocks of different shapes has an identifier for allowing a shape of the each of the blocks of different shapes to be externally identifiable.

6. The last according to claim 1, further comprising:

a central part formed in advance as a core; and a peripheral part that is constituted by the aggregate of the plurality of blocks formed on an outer peripheral portion of the central part.

7. The last according to claim 6, wherein each of the plurality of blocks has at least an outer peripheral surface formed of a material of high heat conductivity.

8. The last according to claim 6, wherein the plurality of blocks include blocks of different shapes, and each of the blocks of different shapes has an identifier for allowing a shape of the each of the blocks of different shapes to be externally identifiable.

9. The last according to claim 1, wherein each of the plurality of blocks has at least an outer peripheral surface formed of a material of high heat conductivity.

10. The last according to claim 1, wherein the plurality of blocks include blocks of different shapes, and each of the blocks of different shapes has an identifier for allowing a shape of the each of the blocks of different shapes to be externally identifiable.

11. The last according to claim 1, wherein the plurality of blocks include blocks of different sizes, and relatively large blocks are arranged on an inner side of the last and relatively small blocks, which are smaller than the relatively large blocks, are arranged on an outer side of the last.

12. The last according to claim 1, wherein each of the plurality of blocks has a hollow interior.

13. The last according to claim 1, comprising:

the aggregate of the plurality of blocks on an upper side of a plate-shaped base part for shaping a lower part of the shoe upper.

14. A method for producing a shoe upper, comprising:

placing an unshaped upper on the last according to claim 1, the unshaped upper composed of a fiber sheet comprising heat-shrinkable yarns; and shaping the unshaped upper in conformity with the shape of the last by heating to obtain a shaped upper.

15. A method for producing a last for shaping a shoe upper, the method comprising:

forming the last by joining a plurality of blocks together to form an aggregate, the plurality of blocks including a first plurality of blocks which are identical to each other; and at least partially covering an outer peripheral portion of the aggregate of the plurality of blocks by a cover part attached to the plurality of blocks and shaped to fill steps or gaps among the aggregate of the plurality of blocks caused by connecting adjacent ones of the blocks, to form an outer peripheral shape of the last, the outer peripheral shape of the last including a curved surface disposed over the steps or gaps.

16. The method for producing the last according to claim 15, further comprising:

acquiring a user's foot shape data;

generating block joining data from the user's foot shape data; and joining the plurality of blocks together based on the block joining data to form the last.

17. The method for producing the last according to claim 16, further comprising:

creating the block joining data based on the user's foot shape data individually generated for each of a plurality of users.

18. The method for producing the last according to claim 17, further comprising:

generating the user's foot shape data from image data obtained by capturing an image of the user's foot.

19. The method for producing the last according to claim 15, further comprising:

disassembling the last, after being used, into the plurality of blocks.

* * * * *